US010278457B2

(12) United States Patent
Hayashi

(10) Patent No.: US 10,278,457 B2
(45) Date of Patent: May 7, 2019

(54) FEMALE SNAP BUTTON

(71) Applicant: YKK Corporation, Tokyo (JP)

(72) Inventor: Daisuke Hayashi, Tokyo (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/527,201

(22) PCT Filed: Nov. 21, 2014

(86) PCT No.: PCT/JP2014/080952
§ 371 (c)(1),
(2) Date: May 16, 2017

(87) PCT Pub. No.: WO2016/079873
PCT Pub. Date: May 26, 2016

(65) Prior Publication Data
US 2017/0325551 A1 Nov. 16, 2017

(51) Int. Cl.
*A44B 17/00* (2006.01)

(52) U.S. Cl.
CPC ..... *A44B 17/0005* (2013.01); *A44B 17/00* (2013.01); *A44B 17/0011* (2013.01);
(Continued)

(58) Field of Classification Search
CPC ..... A44B 17/0076; A44B 17/0005; A44B 17/0052; Y10T 24/45257; Y10T 24/45864;
(Continued)

(56) References Cited

U.S. PATENT DOCUMENTS 1,716,462 A * 6/1929 Reiter ..... A44B 17/0076 24/671
3,614,815 A 10/1971 Nysten
(Continued)

FOREIGN PATENT DOCUMENTS

EP 1038460 A1 9/2000
JP 46-001474 A 9/1971
(Continued)

OTHER PUBLICATIONS

International Search Report, PCT Application No. PCT/JP2014/080952, dated Feb. 17, 2015.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

A snap button includes a female snap body and a socket ring. The female snap body includes a bottom portion and a side wall rising from a peripheral edge of the bottom portion, the side wall provided with a holding portion for holding the socket ring. The socket ring includes a flange portion arranged radially outward and held by the holding portion and an engaging portion arranged radially inside the flange portion. The engaging portion protrudes downwardly toward the bottom portion side of the female snap body and below the flange portion, in the axial direction of the socket ring. An inner diameter of the socket ring may be gradually increased from an intermediate point in the axial direction of the engaging portion to one end and other end in the axial direction of the engaging portion. The engaging portion of the socket ring may be provided with a plurality of slits along the radial direction in the circumferential direction.

3 Claims, 10 Drawing Sheets

(52) U.S. Cl.
CPC ..... *A44B 17/0052* (2013.01); *A44B 17/0076* (2013.01); *Y10T 24/45775* (2015.01); *Y10T 24/45874* (2015.01)

(58) Field of Classification Search
CPC ..... Y10T 24/45099; Y10T 24/45775; Y10T 24/45874; Y10T 24/366; Y10T 24/45932
See application file for complete search history.

(56) References Cited

U.S. PATENT DOCUMENTS

| | | | | |
|---|---|---|---|---|
| 4,641,401 | A * | 2/1987 | Hasegawa | A44B 17/0076 24/108 |
| 4,847,959 | A | 7/1989 | Shimada et al. | |
| 6,584,655 | B1 * | 7/2003 | Cardwell, III | F16B 45/00 24/324 |
| 9,839,263 | B2 * | 12/2017 | Villa | A44B 17/0052 |
| 2005/0050693 | A1 | 3/2005 | Yang | |
| 2014/0137373 | A1 * | 5/2014 | Villa | A44B 17/0023 24/108 |
| 2015/0033507 | A1 * | 2/2015 | Brigato | A44B 1/44 24/95 |

FOREIGN PATENT DOCUMENTS

| | | | |
|---|---|---|---|
| JP | 111409/1987 | U | 7/1987 |
| JP | 63-90 | Y | 1/1998 |

OTHER PUBLICATIONS

International Preliminary Report on Patentability, PCT Application No. PCT/JP2014/080952, dated Jun. 1, 2017.

Supplementary European Search Report, European Patent Application No. 14906300.0, dated Apr. 10, 2018.

* cited by examiner

FEMALE SNAP BUTTON

This application is a national stage application of PCT/JP2014/080952, which is incorporated herein by reference.

TECHNICAL FIELD

The present invention relates to a female snap button to be attached to and detached from a male snap button.

BACKGROUND ART

Snap buttons which attaches and detaches female snap buttons and male snap buttons are widely used for clothes, bags, and the like. The male snap button generally has a protrusion having a tip with a slightly larger diameter. By engaging and disengaging the protrusion with and from a protrusion receiving portion of the female snap button, the female snap button and the male snap button are connected and disconnected. There is known one type of the female snap button, in which an annular spring as a separate member is incorporated in a metallic female snap body, as shown in FIG. 6 of Japanese Utility Model Publication No. S63-90 A1. Such a spring is generally formed by cutting and bending a metal or resin wire member having a circular cross section. The female snap body is provided with a spring holding portion for holding the spring. When connecting the male snap button to the female snap button, the protrusion of the male snap button is inserted into the spring of the female snap button. At this time, the tip with a slightly larger diameter (a larger diameter portion) of the protrusion engages with the spring and elastically expands the spring radially outward, and as soon as the larger diameter portion passes across the spring, the spring is restored radially inward while holding the protrusion. This will lead to connection of the female snap button and the male snap button. Also in the case where both are disengaged, the larger diameter portion of the protrusion is engaged with the spring and the spring temporarily expands outward in the radial direction.

At present time, there is a need for a snap button as thin as possible in clothes and the like. However, the spring having the circular cross section of the female snap button as described above cannot reduce the size, i.e., the diameter so much, in order to maintain elastic deformation performance and holding force for engaging with the protrusion of the male snap button and holding it. Further, the spring holding portion of the snap body requires at least the thickness of the diameter of the spring (the length along the axial direction of the female snap button) to house such a spring. Therefore, when attempting to reduce the thickness of the entire female snap button, the spring itself and the spring holding portion requiring the thickness of the spring diameter have been bottlenecks.

PRIOR ART DOCUMENT

Patent Document

[Patent Document 1] Japanese Utility Model Publication No. S63-90 A1

SUMMARY OF THE INVENTION

Problem to be Solved by the Invention

In light of the above problems, an object of the present invention is to provide a female snap button capable of reducing the thickness.

Means for Solving the Problem

In order to solve the above problems, the present invention provides a female snap bottom comprising a female snap body and a socket ring to be incorporated in the female snap body, wherein the female snap body comprises a bottom portion and a side wall rising from a peripheral edge of the bottom portion, the side wall being provided with a holding portion for holding the socket ring, wherein the socket ring comprises a flange portion arranged radially outward and held by the holding portion and an engaging portion arranged radially inside the flange portion, and wherein the engaging portion protrudes downwardly toward the bottom portion side of the female snap body and below to the flange portion, in the axial direction of the socket ring.

In the female snap button according to the present invention, the flange portion of the socket ring is held by the holding portion of the female snap body, and the engaging portion of the radially inner side of the flange portion of the socket ring is engaged with a protrusion of a male snap button during engagement with or disengagement from the male snap button. In this way, the socket ring is divided into the flange portion that plays a role of being held by the holding portion of the female snap body and the engaging portion that plays a role of engaging with the protrusion of the male snap button. In the present invention, the flange portion of the socket ring is relatively thin, while the engaging portion engaging with the protrusion of the male snap button is extended downwardly toward the bottom portion side of the female snap body and below the flange portion in the axial direction. This will allow the holding portion of the female snap body holding the flange portion to be thinner, and also can ensure elastic deformation performance and holding force, which are required for engagement with the protrusion portion and for holding it.

The female snap body according to the present invention may be formed from a metal such as titanium, iron, copper, aluminum, nickel, zinc, or an alloy thereof, but not limited thereto. The socket ring may be formed from an elastomer, a synthetic resin, a metal or the like.

In an embodiment of the present invention, an inner diameter of the socket ring is gradually increased from an intermediate point in the axial direction of the engaging portion to one end and other end in the axial direction of the engaging portion. Thus, the engaging portion of the socket ring has both ends in the axial direction, which are positioned radially more outward than the intermediate point. This facilitates attachment and detachment of the protrusion of the male snap button to and from the engaging portion of the socket ring. Here, the "intermediate point" refers to a point located just in an intermediate position between the one side end and the other side end in the axial direction of the engaging portion or a point near the intermediate position.

In one embodiment of the present invention, the holding portion includes a lower holding portion supporting the bottom portion side in the flange portion of the socket ring, a side holding portion rising from a radially outer side of the lower holding portion, and an upper holding portion extending radially inward from an end portion of the side away from the lower holding portion in the side holding portion, wherein the engaging portion protrudes downwardly toward the bottom portion side and below the lower holding portion. In this way, the engaging portion of the socket ring protrudes downwardly toward the bottom portion side of the male snap body and below the lower holding portion, so that it will be easy to provide elastic deformation performance and the like required for the engaging portion.

In one embodiment of the present invention, the engaging portion of the socket ring is provided with a plurality of slits along the radial direction in the circumferential direction. By providing the plurality of such slits to the engaging portion of the socket ring, the elastic deformation of the engaging portion in the radial direction can be increased during engagement with the protrusion of the male snap button.

In an embodiment of the present invention, the socket ring is provided with a groove recessed on the side opposite to the bottom portion side of the female snap body in the axial direction. By providing such a groove, the elastic deformation of the engaging portion in the radial direction can be facilitated during engagement with the protrusion of the male snap button.

In the present invention, the flange portion of the socket ring is relatively thin, while the engaging portion allowing engagement with the protrusion portion of the male snap button is extended downwardly toward the bottom portion side of the female snap body and below the flange portion in the axial direction, so that the holding portion of the female snap body, which holds the flange portion, can be formed thinly and the elastic deformation performance and holding force which are required for engaging with the protrusion portion of the male snap button and holding it can be ensured at the engaging portion.

MODES FOR CARRYING OUT THE INVENTION

Figure 1:
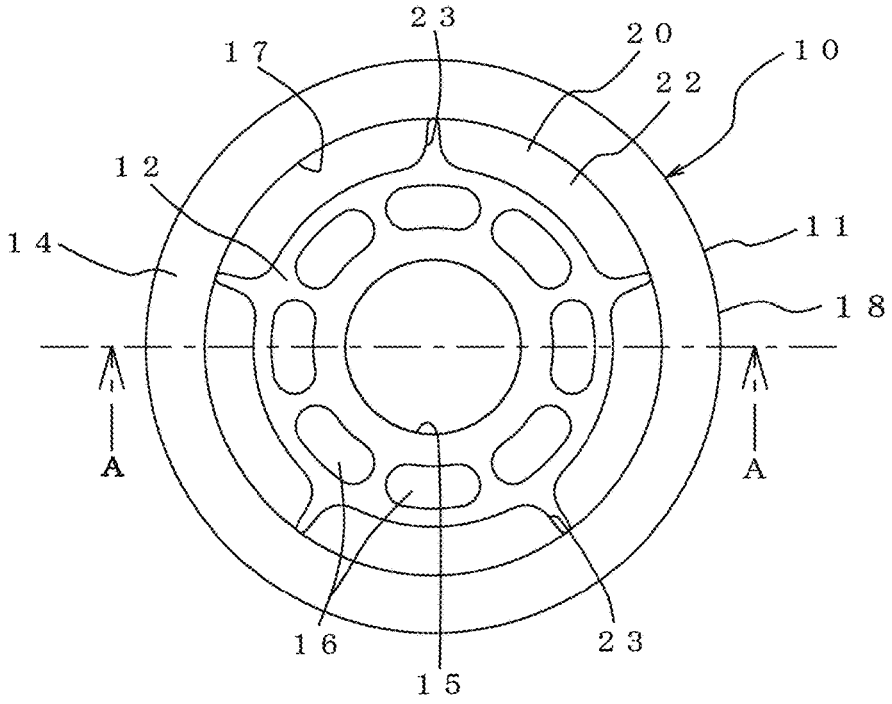
FIG. 1 is a plan view of a female snap button according to an embodiment of the present invention.
Figure 2:
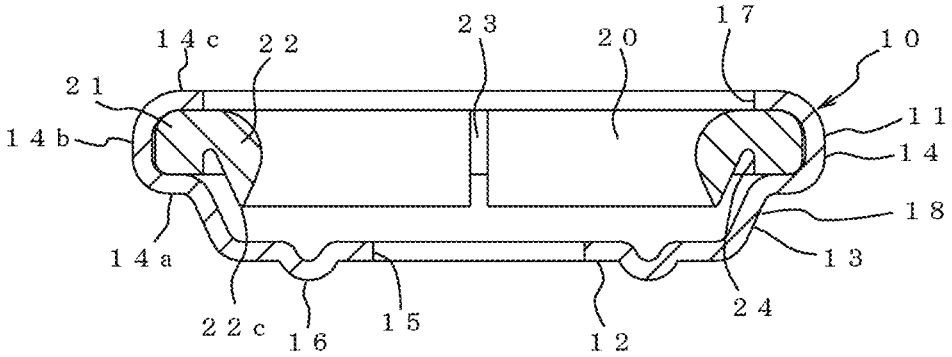
FIG. 2 is a cross-sectional view taken along the line A-A of FIG. 1.

Preferred embodiments of the present invention will be described below with reference to the accompanying figures, but the present invention is not limited to these embodiments, and appropriate modifications and the like can be made within the scope of the claims and the equivalent scope. FIG. 1 is a plan view of a female snap button (hereinafter simply referred to as a "female snap") 10 according to an embodiment of the present invention. FIG. 2 is a cross-sectional view taken along the line A-A of FIG. 1. The female snap 10 is composed of a metallic female snap body 11 and a resinous annular socket ring 20 housed in the female snap body 11. The female snap body 11 is formed by drawing a metal plate or the like, and comprises a bottom portion 12 and a side wall 18 rising upwardly in the axial direction from a radially outer end (peripheral edge) of the bottom portion 12 (it should be noted that the up and down direction regarding the female snap 10 is based on a paper surface of each of FIGS. 2, 4, 5, 6 and the like). The side wall 18 comprises an inclined portion 13 that extends with slightly expanding radially outward from the peripheral edge of the bottom portion 12; and a holding portion 14 for holding the socket ring 20, which bends in a substantially C-shape from the upper end of the inclined portion 13 to the radial outside, then to the upward direction and then to radially inward direction. The bottom portion 12 of the female snap body 11 is provided with a circular opening 15 for passing a post 32 of a fitting 30 when attaching the female snap 10 to a fabric 1 (see FIG. 7 and the like). Further, in the bottom portion 12, eight convex portions 16 protruding downwardly in a substantially oval shape are also provided at regular intervals in the circumferential direction, nearly in the middle between a radially outer end of the opening 15 in the radial direction of the female snap body 11 and a radially outer end of the bottom portion 12. The longitudinal side of the convex portion 16 is along the circumferential direction. The inclination angle of the inclined portion 13 relative to the bottom portion 12 is not particularly limited, and in this embodiment, it is about 120 degrees as an example.

The holding portion 14 comprises a lower holding portion 14*a* extending radially outward from the upper end of the inclined portion 13; a side holding portion 14*b* extending upward from the radially outer end of the lower holding portion 14*a*; and an upper holding portion 14*c* extending radially inward from the upper end of the side holding portion 14*b* to terminate. The radially inner end of the upper holding portion 14*c* defines an upper opening 17 of the female snap body 11. Further, the position of the radially inner end of the upper holding portion 14*c* in the radial direction of the female snap body 11 is near the boundary between the inclined portion 13 and the lower holding portion 14*a*. The holding portion 14 holds a flange portion 21 as described below of the socket ring 20 between the upper holding portion 14*c* and the lower holding portion 14*a*.

Figure 3:
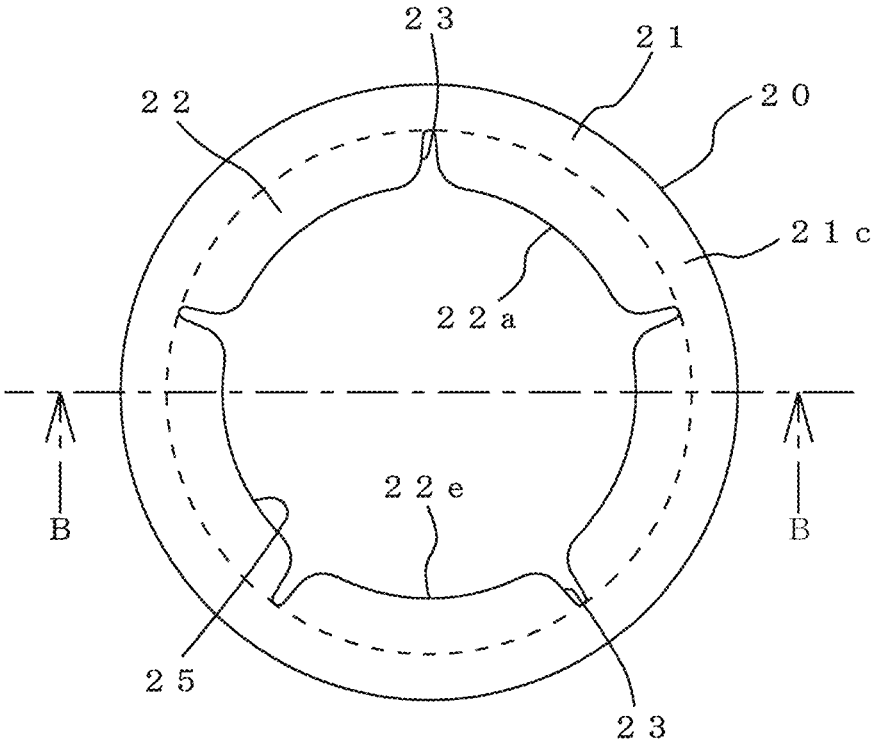
FIG. 3 is a plan view of a socket ring.
Figure 4:
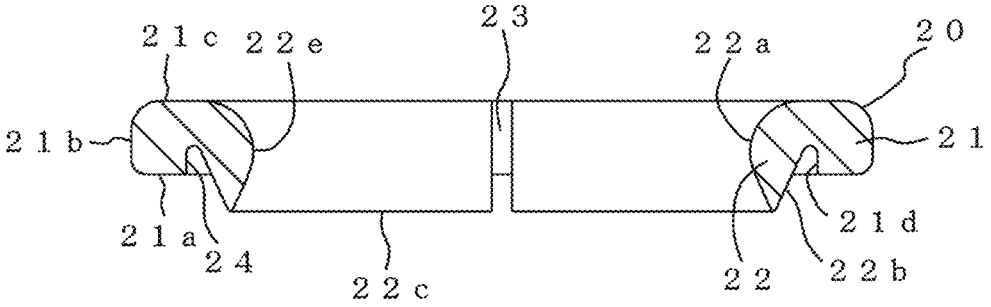
FIG. 4 is a cross-sectional view taken along the line B-B of FIG. 3.

FIG. 3 is a plan view of the socket ring 20. FIG. 4 is a cross-sectional view taken along the line B-B in FIG. 3. The socket ring 20 includes the flange portion 21 that is arranged radially outward and held by the holding portion 14 of the female snap body 11; and an engaging portion 22 that is arranged radially inward and allows engagement with a protrusion portion 42 of a male snap button (hereinafter simply referred to as a "male snap") 40 (see FIGS. 7 and 8) when attaching and detaching the male snap 40 to and from the female snap button 10. The engaging portion 22 extends radially inward from the flange portion 21 and protrudes below the flange portion 21, as described in detail below. The holding portion 14 of the female snap body 11 is formed so as to place the socket ring 20 on the female snap body 11 before forming the holding portion 14 shown in FIG. 6 and then cover the flange portion 21 of the socket ring 20, as will be described below. The flange portion 21 has a flange lower surface 21*a* facing the lower holding portion 14*a*; a flange outer surface 21*b* facing the side holding portion 14*b*; and a flange upper surface 21*c* facing the upper holding portion 14*c*. The up and down direction length between the flange upper surface 21*c* and the flange lower surface 21*a*, i.e., the thickness of the flange portion 21 is equal to or slightly longer than the up and down direction length of the space between the upper holding portion 14*c* and the lower holding portion 14*a*. The flange portion 21 of the socket ring 20 is held by the holding portion 14, whereas the engaging portion 22 is spaced radially inward from the holding portion 14.

Figure 5:
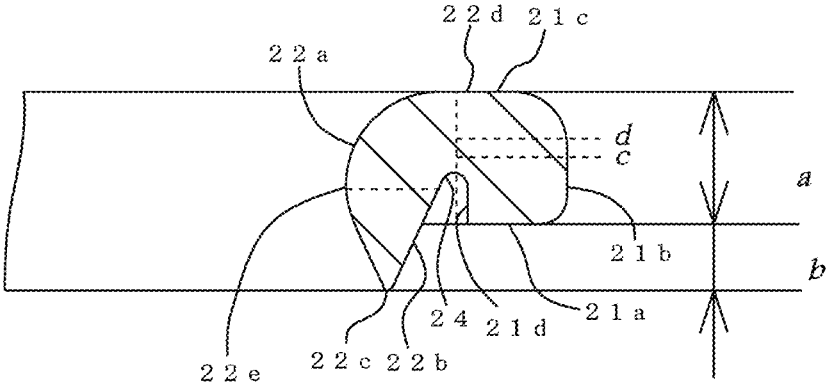
FIG. 5 is a partially enlarged view of FIG. 4.

Referring to FIG. 3 and the like, the engaging portion 22 of the socket ring 20 is provided with five slits 23 at intervals of 72 degrees in the circumferential direction, as an example. Each slit 23 is forming by notching the engaging portion 22 along the radial direction, but it does not reach the flange portion 21. Further, the engaging portion 22 extends in an arc shape along the circumferential direction, between the two slits 23 adjacent to each other in the circumferential direction. This will allow an opening 25 defined radially inward by (an inner end 22*e* as described below of) the engaging portion 22 to be circular. Also referring to FIG. 4 and the like, the socket ring 20 is provided with an annular groove 24 recessed upward adjacent to the radially inner end of the flange lower surface 21*a* of the flange portion 21. The groove 24 is continuously provided in the circumferential direction. FIG. 5 is a partially enlarged view of FIG. 4. The engaging portion 22 of the socket ring 20 has an engaging surface 22*a* that is a curved surface which is inwardly convex in the radial direction. A lower end 22*c* that is one end in the up and down direction (the axial direction) of the engaging surface 22*a* is lower than the flange lower surface 21*a* in the up and down direction. As shown in FIG. 2, the position of the lower end 22*c* of the engaging surface 22*a* is lower than the lower holding portion 14*a* of the snap body 11. As can be seen from FIG. 3, the engaging surface 22*a* extends along the circumferential direction of the socket ring 20. Further, the engaging portion 22 is provided with an annular inclined surface 22*b* which is inclined radially outward and upward from the lower end 22*c* of the engaging surface 22*a* in a straight line as viewed in the cross-section to form a radially inward side surface of the groove 24. The radially outer side surface of the groove 24 is defined by a flange inner surface 21*d* along the up and down direction of the flange portion 21. The inclined surface 22*b* and the flange inner surface 21*d* form an angle of about 30° in the cross section, but the inclined surface 22*b* and the flange inner surface 21*d* are connected in a curved shape at the upper end portion of the groove 24. Referring to FIG. 5, an up and down direction length b in which the engaging portion 22 protrudes downward from the flange lower surface 21*a* is shorter than an up and down length a of the flange portion 21, but longer than half of the up and down direction length a of the flange portion 21, in this embodiment.

For convenience of explanation, the socket ring 20 is defined as being divided into the flange portion 21 and the engaging portion 22 by a surface extending upwardly the flange inner surface 21*d* that is a radially outer side surface of the groove 24, and the radially inner end of the flange upper surface 21*c* of the flange portion 21 is defined as the upper end 22*d* of the engaging portion 22. The upper end 22*d* is the other side end of the engaging surface 22*a* in the up and down direction, opposite to the lower end 22*c* that is one side end as described above. In the engaging surface 22*a* of the engaging portion 22, the inner diameter gradually decreases downward from the upper end 22*d*, the inner diameter then reaches the minimum at an intermediate point 22*e* in the up and down direction (the axial direction), and the inner diameter then gradually increases toward the lower end 22*c*. Thus, the inner diameter of the socket ring 20 gradually increases from the intermediate point 22*e* toward the upper end 22*d* and the lower end 22*c*. Therefore, both of the inner diameters of the upper end 22*d* and the lower end 22*c* of the engaging portion 22 are larger than the inner diameter of the intermediate point 22*e* of the engaging portion 22. Hereinafter, the intermediate point 22*e* which minimizes the inner diameter of the engaging surface 22*a*, i.e., projects most radially inward, is referred to as an "inner end 22*e*" of the engaging portion 22 or the engaging surface 22*a*. In the present embodiment, the inner end 22*e*, i.e., the intermediate point 22*e* is slightly above the center position of the up and down direction length (thickness) of the engaging portion 22. In addition, the inner end (intermediate point) 22*e* may be located at the center position of the up and down direction length. In the present embodiment, the position of the inner end 22*e* in the up and down direction is slightly lower than an intermediate point c of the up and down direction length of the flange portion 21 and above the flange lower surface 21*a*. Furthermore, it will be appreciated that the position of the inner end 22*e* in the up and down direction is within the range of the groove 24. Further, reference symbol d in FIG. 5 indicates an intermediate point of an up and down direction length of a portion upper than the groove 24 in the socket ring 20. As viewed from the cross section, the engaging surface 22*a* is substantially arcuate from the upper end 22*d* to the inner end 22*e*, slightly curved downward from the inner end 22*e*, and then extends in a substantially straight line to the lower end 22*c*. The cross section of a portion below the flange lower surface 21*a* of the engaging portion 22 has a substantially isosceles triangular shape.

Figure 6:
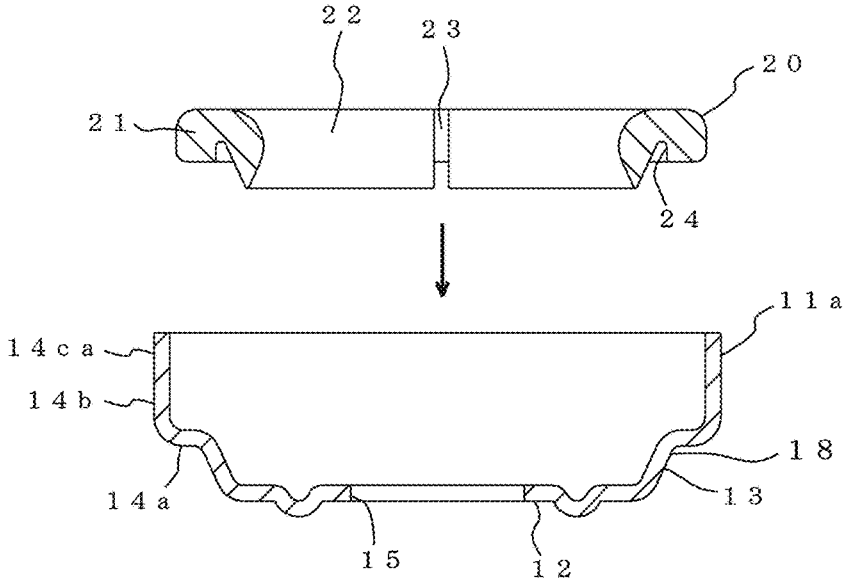
FIG. 6 is a cross-sectional explanatory view of a female snap body and a socket ring before assembly.

FIG. 6 is a cross-sectional explanatory view of the female snap body 11*a* and the socket ring 20 before assembly. The female snap body 11*a* is in a state before the holding portion 14 is formed on the side wall 18 of the snap body 11 and where the portion 14*ca* that will form the upper holding portion 14*c* of the female snap body 11 is not still bent relative to the side holding portion 14*b* and extends on the cross-sectional extension line of the side holding portion 14*b*. Therefore, the female snap body 11*a* before assembly has an upper opening portion wider than an upper opening 17 of the female snap body 11 with the upper holding portion 14*c* with respect to the side holding portion 14*b* to hold the socket ring 20 bent. From this opening portion, the socket ring 20 is placed on the lower holding portion 14*a* inside the snap body 11*a*, and the above portion 14*ca* is then bent radially inward as the upper holding portion 14*c* to form the holding portion 14. As a result, the flange portion 21 of the socket ring 20 is held in the holding portion 14.

Figure 7:
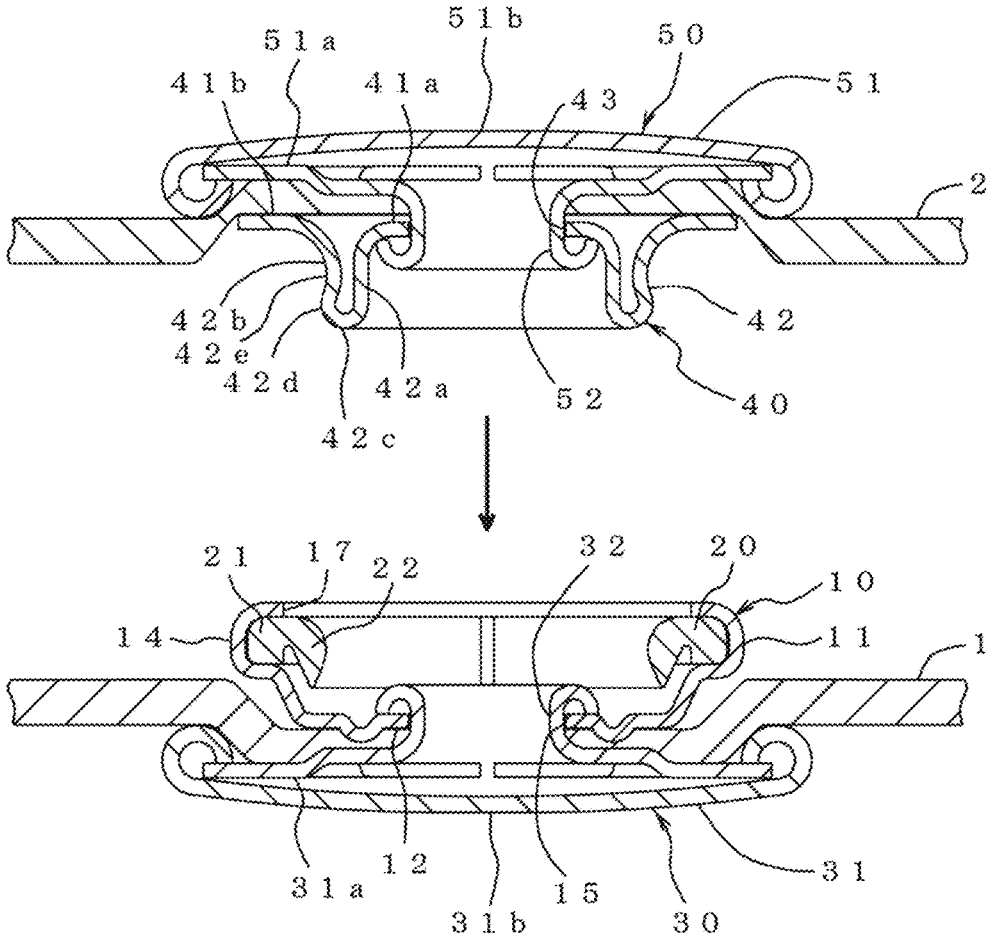
FIG. 7 is a cross-sectional explanatory view showing that a female snap button and a male snap button each attached to a fabric are opposed to each other.

FIG. 7 is a cross-sectional explanatory view showing a state where the female snap 10 and the male snap 40 have been attached to the fabrics 1, 2 by button fittings 30, 50, respectively, and have been opposed to each other. The male snap 40 is formed such as by drawing a single metal plate and has a protrusion 42 engaged with and disengaged from the engaging portion 22 of the socket ring 20 of the female snap 10. The protrusion 42 is formed in a double pipe shape from an inner wall 42*a* and an outer wall 42*b*, and protrusion end sides of the inner and outer side walls 42*a*, 42*b* are connected in curved shapes that protrude downward (the up and down sides of the male snap 40 are based on the paper surfaces of FIGS. 7 and 8) so as to form a protrusion end portion 42*c* of the protrusion 42. Further, the male snap 40 includes an inner bottom portion 41*a* extending radially inward from the base end side of the inner wall 42*a* and an outer bottom portion 41*b* extending radially outward from the base end side of the outer wall 42*b*. The outer bottom portion 41*b* is slightly above the inner bottom portion 41*a* (on the fabric 2 side). The inner bottom portion 41*a* is provided with a circular opening 43 into which a post 52 of a button fitting 50 is inserted. In the protrusion 42, the inner diameter of the inner wall 42*a* is substantially constant, whereas in the outer wall 42*b*, the outer diameter is increased because the outer wall 42*b* is expanded outwardly in the radial direction on the protrusion end portion 42*c* side. Hereinafter, the portion expanded outwardly in the radial direction is referred to as a "larger diameter portion 42*d*". The outer diameter of the outer wall 42*b* is slightly reduced upward from the larger diameter portion 42*d* and then expanded to be connected to the outer bottom portion 41*b*. Therefore, the outer peripheral surface of the outer wall 42*b* of the protrusion 42 is protruded radially outward in the larger diameter portion 42*d*, and slightly depressed radially outward in a curved shape, in the upper portion of the larger diameter portion 42*d*. Hereinafter, the recessed portion is referred to as a "smaller diameter portion 42*e*". The outer diameter of the smaller diameter portion 42*e* is equal to or slightly larger than the inner diameter at the inner end 22*e* of the engaging portion 22 of the socket ring 20 in the initial state of the female snap 10. Therefore, the outer diameter of the larger diameter portion 42*d* is larger than the inner diameter at the inner end 22*e* of the engaging portion 22 of the socket ring 20 in the initial state.

The button fittings 30, 50 have the same configuration and include disc-shaped bases 31, 51 and cylindrical posts 32, 52 protruding from the bases 31, 51. The posts 32, 52 are shown in states where they have been deformed from a cylindrical shape by means of caulking in FIG. 7. The button fittings 30, 50 are composed of fitting bodies 30*a*, 50*a* that form the posts 32, 52 and base cores 31*a*, 51*a* which are parts of the base 31 continuing from the posts 32, 52 and facing the fabrics 1, 2; and base covers 31*b*, 51*b* assembled to the base cores 31*a*, 51*a* so as to cover the base cores 31*a*, 51*a* from the side opposite to the fabrics 1, 2. The base covers 31*b*, 51*b* are bent in a C shape so that the radially outer ends thereof protrude toward the fabrics 1, 2, and are then assembled to the radially outer end portions of the base cores 31*a*, 51*a*. When attaching the female snap 10 and the male snap 40 to the fabrics 1, 2, the posts 32, 52 of the button fittings 30, 50 are pierced with the fabrics 1, 2, and then passed through the openings 15, 43 of the female snap 10 and the male snap 40, and then caulked so as to curve radially outward in the cross-sectional C-shape. Consequently, the female snap 10 and the male snap 40 are fixed to the fabrics 1, 2.

Figure 8:
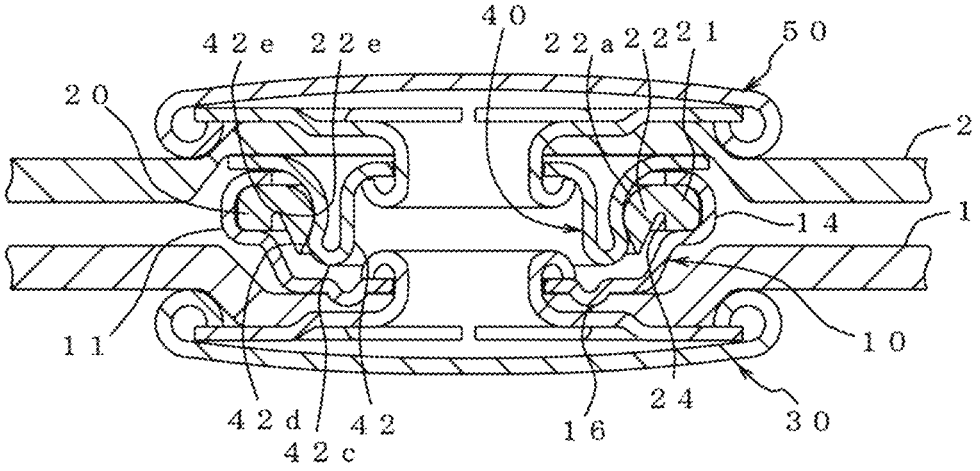
FIG. 8 is a cross-sectional explanatory view showing that a female snap button and a male snap button have been connected to each other.

FIG. 8 is a cross-sectional explanatory view showing a state where the female snap 10 and the male snap 40 have been connected. When connecting the female snap 10 and the male snap 40, the protrusion 42 of the male snap 40 is fitted into the opening 25 of the engaging portion 22 of the socket ring 20 of the female snap 10. At this time, since the outer diameter of the larger diameter portion 42*d* of the protrusion 42 is larger than the inner diameter at the inner end 22*e* of the engaging portion 22 of the socket ring 20, the larger diameter portion 42*d* is passed through the engaging portion 22 while elastically expanding the engaging portion 22 radially outward. Then, as soon as the larger diameter portion 42*d* of the protrusion 42 passes over the inner end 22*e* of the engaging portion 22 downwardly, the engaging portion 22 restores inward in the radial direction (it may not be completely restored in the initial state), so that the engaging surface 22*a* including the inner end 22*e* of the engaging portion 22 is in contact with the outer peripheral surface of the smaller diameter portion 42*e* of the protrusion 42, as shown in FIG. 8. This leads to connection of the female snap 10 and the male snap 40. The radial inward elastic deformation of the engaging portion 22 of the socket ring 20 occurs such that the radial length of the groove 24 is reduced, and the slit 23 facilitates the deformation of the engaging portion 22. In such a connected state, the protrusion end 42*c* of the protrusion 42 of the male snap 40 is in a slightly lower position than the lower end 22*c* of the engaging portion 22. Also, a convex portion 16 of the bottom portion 12 of the female snap 10 bites into the fabric 1 and plays a role of preventing any rotation of the female snap 10. Therefore, according to the present invention, in the socket ring 20, the flange portion 21 plays a role of being held by the holding portion 14 of the female snap body 11 and the engaging portion 22 placed away from the holding portion 14 plays a role of engaging with the protrusion 42 of the male snap 40. Accordingly, the flange portion 21 of the socket ring 20 is thinner than the engaging portion 22 while the engaging portion 22 is allowed to protrude below the flange portion 21, thereby enabling the engaging surface 22*a* to be enlarged in the up and down direction. This can ensure the elastic deformation performance and holding force required for the socket ring 20 while forming the thinner holding portion 14 of the female snap body 11.

Referring to FIG. 5, the inner end 22*e* of the engaging portion 22 of the socket ring 20 is located in a substantially intermediate point of the up and down direction length (thickness) of the engaging portion 22, in the above embodiment. Therefore, for convenience, the intermediate point in the up and down direction of the engaging portion 22 is defined as an "engaging portion intermediate point 22*e*". If the engaging portion intermediate point 22*e* is in the same position as the intermediate point c of the up and down direction length of the flange portion 21, the engaging portion 22 and the flange portion 21 will have the same up and down direction length. In this case, the engaging force of the engaging portion 22 against the protrusion 42 of the male snap 40, i.e., the snap force, will become too strong. Therefore, in the above embodiment, the engaging portion 22 is extended below the flange portion 21, so that the engaging portion intermediate point 22*e* is set below the intermediate point c of the flange portion 21. Also, the elastic deformation of the engaging portion 22 is maximized at the inner end 22*e* which is the most radially inwardly protruding part and has the groove 24 present radially outward. On the other hand, if the inner end 22*e* is set at the intermediate point d of the up and down direction length of the portion above the groove 24, the deformation of the engaging portion 22 will be decreased as compared with the case where the groove 24 is present radially outward. Therefore, in the above embodiment, the inner end 22*e* of the engaging portion 22 is set at a position that falls within the range of the groove 24 in the up and down direction.

Figure 9:
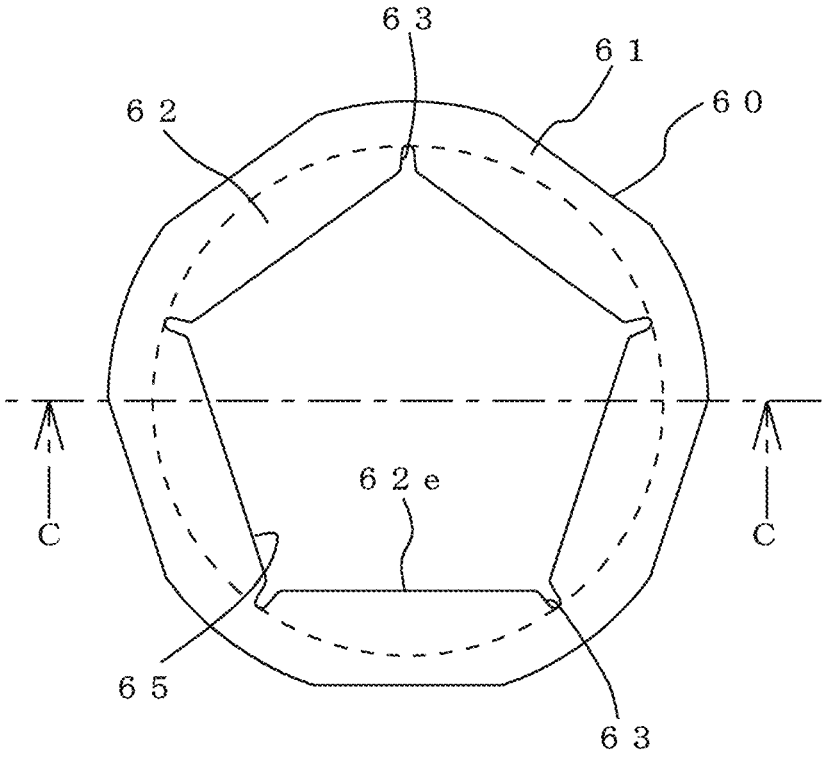
FIG. 9 is a plan view showing a variation of the socket ring.
Figure 10:
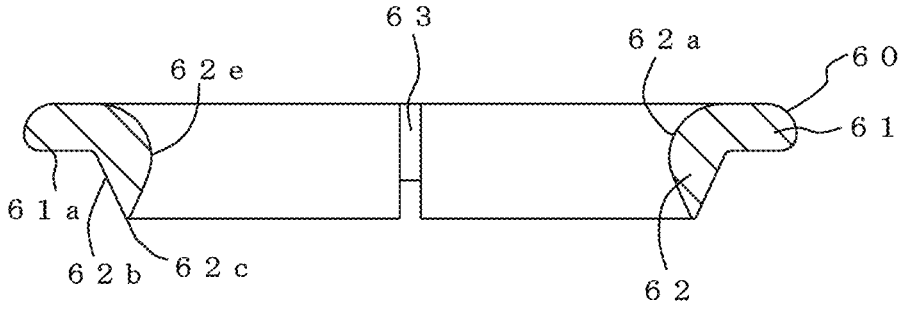
FIG. 10 is a cross-sectional view taken along the line C-C of FIG. 9.

FIG. 9 is a plan view showing a socket ring 60 which is a variation of the socket ring, and FIG. 10 is a cross-sectional view taken along the line C-C of FIG. 9. The socket ring 60 comprises a radially outer flange portion 61 to be held by the holding portion 14 of the snap body 11 as stated above and a radially inner engaging portion 62 to be engaged with the protrusion 42 of the male snap 40. The engaging portion 62 protrudes below the flange portion 61. The up and down direction length of the engaging portion 62 is approximately 2.5 times the up and down direction length of the flange portion 61 in the present embodiment. In the socket ring 60, any groove corresponding to the groove 24 of the socket ring 20 is not provided between a flange lower surface 61*a* and an inclined surface 62*b* that forms the radially inner side surface of the engaging portion 62. Further, an inner end 62*e* that is a most radially inward protruding part on the engaging surface 62*a* of the engaging portion 62 is located in an approximately intermediate position of the up and down direction length of the engaging portion 62 and is slightly lower than the flange lower surface 61*a*, therefore below the up and down direction intermediate point of the flange portion 61. Referring to FIG. 9, the engaging portion 62 of the socket ring 60 is provided with five slits 63 at intervals of 72° in the circumferential direction as an example. Further, between the two slits 63 adjacent in the circumferential direction, the engaging portion 62 linearly extends and the length inwardly protruding in the radial direction of the engaging portion 62 becomes shorter as it got closer to the slit 63, and is the longest at the intermediate point between the two slits 63. Accordingly, an opening 65 defined radially inward by the engaging portion 62 is pentagonal. Furthermore, the slit 63 is shorter in the radial direction as compared with the slit 23 of the socket ring 20. The outer periphery of the flange portion 61 is substantially circular, but it is partially cut in a straight fashion so as to be parallel to the linear inner end 62*e* of the engaging portion 62, in a region corresponding to that between two slits 63 adjacent to each other in the circumferential direction. In the female snap (not shown) in which the socket ring 60 has been incorporated in the female snap body 11 as described above, the engaging portion 62 does not elastically deform almost uniformly in the circumferential direction, but cause smaller deformation on the side of two slits 63 adjacent in the circumferential direction and cause the largest deformation at the middle between the two slits 63, when the socket ring 60 is engaged with the protrusion 42 of the male snap 40 during attachment to and detachment from the male snap 40, Therefore, the elastic deformation performance and holding force change in the circumferential direction.

EXPLANATION OF SIGN

10 female snap button
11 female snap body
12 bottom portion
14 holding portion
18 side wall
20, 60 socket ring
21, 61 flange portion
22, 62 engaging portion
22*a*, 62*a* engaging surface
22*c*, 62*c* lower end of engaging surface
22*e*, 62*e* inner end
23, 63 slit
24 groove
30, 50 button fitting
32, 52 post
40 male snap button
42 protrusion

What is claimed is:

1. A female snap bottom comprising a female snap body and a socket ring to be incorporated in the female snap body, wherein the female snap body comprises a bottom portion and a side wall rising from a peripheral edge of the bottom portion, the side wall being provided with a holding portion for holding the socket ring, wherein the socket ring comprises a flange portion arranged radially outward and held by the holding portion and an engaging portion arranged radially inside the flange portion, wherein the engaging portion protrudes downwardly toward the bottom portion side of the female snap body and below the flange portion, in the axial direction of the socket ring, wherein the engaging portion of the socket ring is provided with a plurality of slits along the radial direction in the circumferential direction, and wherein the holding portion includes a lower holding portion, a side holding portion and an upper holding portion, and wherein the engaging portion protrudes downwardly toward the bottom portion side and below the lower holding portion.

2. The female snap bottom according to claim 1, wherein an inner diameter of the socket ring is gradually increased from an intermediate point in the axial direction of the engaging portion to one end and to an other end in the axial direction of the engaging portion.

3. The female snap bottom according to claim 1, wherein the socket ring is provided with a groove recessed on the side opposite to the bottom portion side of the female snap body in the axial direction.

* * * * *